United States Patent [19]

Weigl et al.

[11] 4,253,250

[45] Mar. 3, 1981

[54] SHOE FASTENER

[75] Inventors: Erwin Weigl, Brunn a. Gebirge; Axel Kubelka, Vienna, both of Austria

[73] Assignee: Polyair Produkt Design Gesellschaft m.b.H., Kittsee, Austria

[21] Appl. No.: 967,874

[22] Filed: Dec. 8, 1978

[30] Foreign Application Priority Data

Dec. 19, 1977 [AT] Austria ..... 9093/77

[51] Int. Cl.[3] ..... A43B 11/00; F16G 11/00

[52] U.S. Cl. ..... 36/50; 24/130

[58] Field of Search ..... 36/50; 24/68 SK, 69 SK, 24/70 SK, 71 SK, 130

[56] References Cited

U.S. PATENT DOCUMENTS

| | | | |
|---|---|---|---|
| 2,861,310 | 11/1958 | Martin | 24/68 SK |
| 3,343,809 | 9/1967 | Newell | 24/130 |
| 3,812,811 | 5/1974 | Rodriguez | 24/130 |
| 3,834,048 | 9/1974 | Maurer | 36/50 |
| 3,845,575 | 11/1974 | Boden | 36/50 |
| 4,096,648 | 6/1978 | Guolo | 24/68 SK |

*Primary Examiner*—Patrick D. Lawson

*Attorney, Agent, or Firm*—Scully, Scott, Murphy & Presser

[57] ABSTRACT

A shoe fastener, particularly for skiing boots, including a tightening member which acts on a tension element, and a device for fixing the tension element and for selecting the effective length thereof. The device for fixing the tension element includes a groove which tapers toward its bottom and extends in the longitudinal direction of the tension element and is defined by side faces, at least one of which is formed with ribs, each of which at least at its end near the bottom of the groove extends transversely to the longitudinal axis of the groove and each rib and the pulling direction of the tension element inserted in the groove includes an angle which is open toward the open side of the groove and exceeds 90°.

7 Claims, 15 Drawing Figures

SHOE FASTENER

This invention relates to a shoe fastener, particularly for skiing boots, comprising a tightening member which acts in a tension element, and means for fixing the tension element and for adjusting the effective length thereof. In various known fasteners for skiing boots, the tension element is adapted to be inserted into various openings of a tightening lever so that the tension element can be adjusted or tensioned when the tightening lever is held in position. It is also known to provide devices by which the effective length of the tension element can be adjusted in small steps or even continuously.

A known device of that kind comprises a tightening member which is provided on one side of the shoe parts that are to be pulled toward each other, and a toggle for fixing the tension element on the surface of the skiing boot on the other side of the skiing boot by pressure contact and for adjusting the effective length of the tension element. That design and various other designs of the same kind have the disadvantage that it is complicated to insert the tension element into the device for fixing the tension element and to adjust the effective length thereof. As a rule, the tension elements consisted of flexible straps, which had to have a certain tensile strength and for this reason were relatively stiff. It is very difficult to insert such stiff strap into a relatively narrow slot between the surface of the boot and a toggle for clamping the strap.

It is an object of the present invention to provide a device which is of the kind described above and which is as simple as possible and can easily be operated and can be manufactured most economically. The device should also be capable of a fine adjustment so that the desired closing pressure can easily be selected. This object is accomplished by the invention essentially in that the device for fixing the tension element comprises a groove, which tapers toward its bottom and extends in the longitudinal direction of the tension element and which is defined by side faces, at least one of which is formed with ribs, each of which at least at its end near the bottom of the groove extends transversely to the longitudinal axis of the groove, and each rib and the pulling direction of the tension element inserted into the groove include an angle which is open toward the open side of the groove and exceeds 90°. Because the device for fixing the tension element has a groove which tapers toward its bottom, the tension element can simply be inserted into the groove and need not be threaded. The ribs provided on at least one side face of the groove ensure that the tension element will be automatically clamped in the device for fixing the tension element when the tightening member is closed. Such a device for fixing the tension element can simply be made in one piece, e.g., by injection moulding or by other manufacturing processes, e.g., by stamping from sheet metal. In a preferred embodiment of the invention, the device for fixing the tension element is integral with the surface of the shoe.

The ribs for clamping the tension element preferably have side faces which are steeper on the side which faces opposite to the pulling direction than on the side which faces in said direction. This design ensures a reliable fixation of the tension element in the device for fixing the tension element. The device for fixing the tension element may preferably be formed by a portion of the tightening member or may be secured to the shoe on that side which is opposite to the tightening member.

In another embodiment of the invention the groove tapering toward its bottom is a peripheral groove in a substantially cylindrical body, at least one of the side faces defining the peripheral groove is provided with ribs, and the direction of each rib or a tangent at its root includes an acute angle with a radial line extending through the root of the rib near the bottom of the groove. This feature ensures a reliable clamping of the tension element in the peripheral groove. The cylindrical body may have the shape of a mushroom and one of the side walls of the peripheral groove which tapers toward the bottom of the groove may be formed by the surface of the shoe or by that surface of the tightening member which faces the shoe or faces away from the shoe.

In the device according to the invention, the tension element desirably consists of a flexible strap which is trapezoidal in cross-section. If the smallest width of such tension element exceeds the width of the groove at its bottom, the positive interlock will be reliably retained even when substantial wear has occurred. The trapezoidal shape of the strap greatly improves the anchorage. To decrease the danger of a deflection of the strap, the same may be provided with stiffening ribs, which extend transversely to the longitudinal direction of the strap, preferably in the narrowest portion thereof if the strap is provided with teeth on one or both of its longitudinal sides.

The invention will now be explained more in detail with reference to the drawings, which show illustrative embodiments with further details which are important within the scope of the invention.

Figure 6:
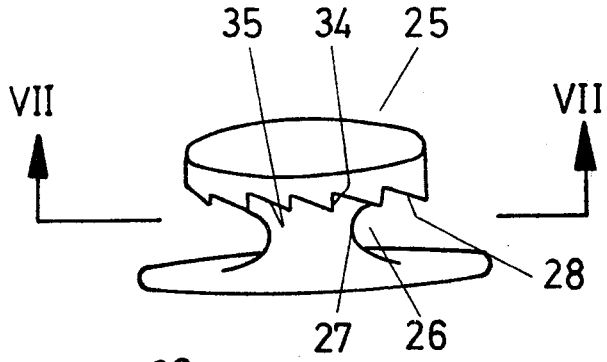
Figure 8:
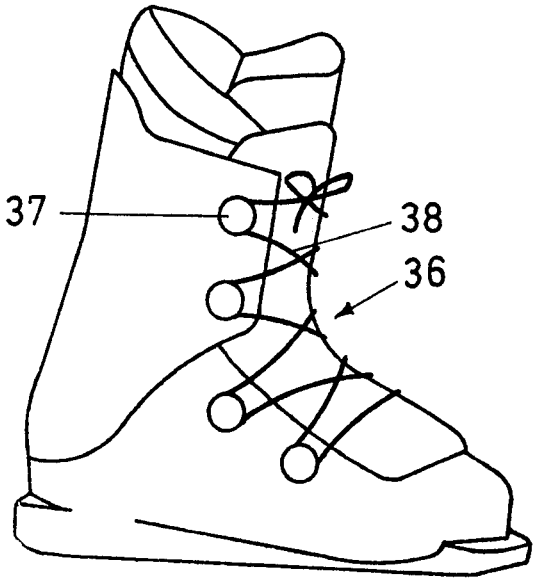

FIG. 8 an elevation showing a shoe provided with device according to FIG. 6 for fixing a tension element.

Figure 1:
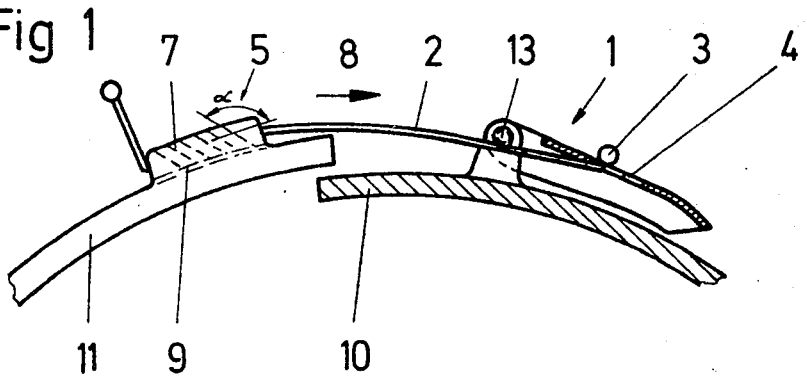
FIG. 1 is a diagrammatic side elevation showing a shoe fastener according to the invention.
Figure 9:
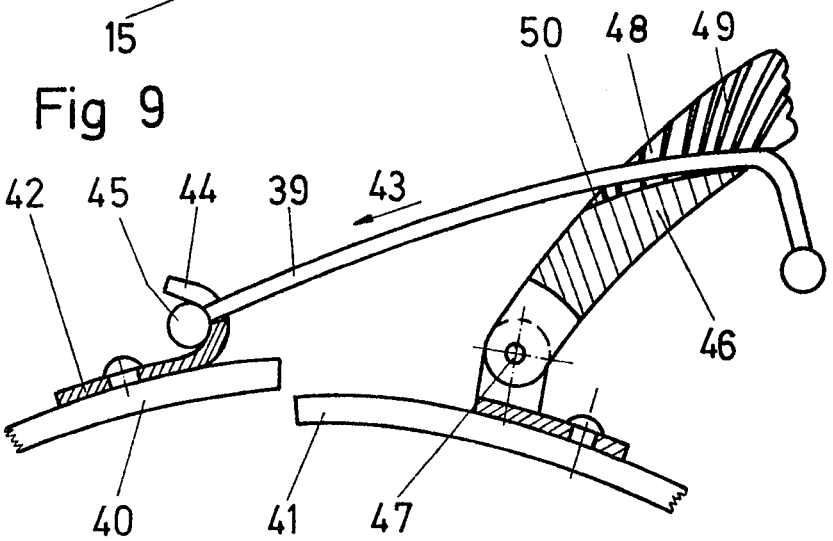
Figure 10:
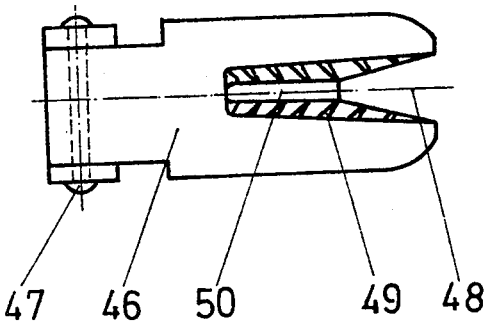
Figure 11:
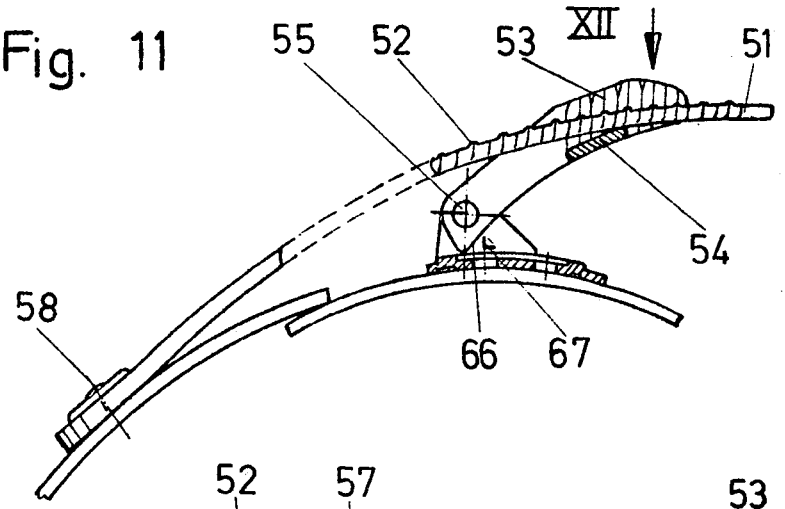
Figure 12:
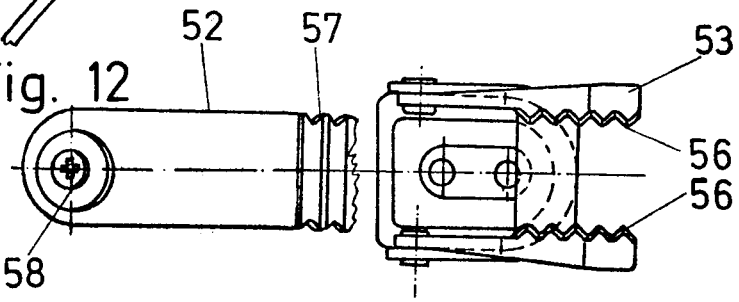
Figure 15:
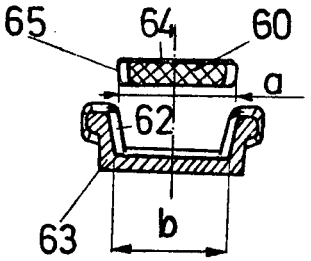
Figure 13:
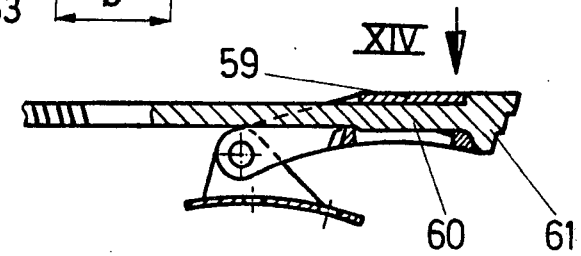
Figure 14:
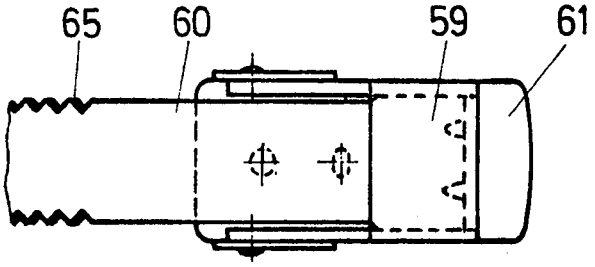

FIG. 9 shows an embodiment in which the device for fixing the tension element is provided on the tightening member, in a sectional view on a plane through the tension element, FIG. 10 is a top plan view showing the tightening member of FIG. 9, FIG. 11 a sectional view which is similar to FIG. 1 and shows another embodiment, FIG. 12 a top plan view taken in the direction of the arrow XII in FIG. 11, FIG. 13 a longitudinal sectional view showing another embodiment of a tightening member, FIG. 14 a top plan view taken in the direction of the arrow XIV in FIG. 13, and FIG. 15 a transverse sectional view showing a tension element and a profiled member for receiving the tension element.

With reference to FIG. 1, a tension element 2 is fixed to a tightening member 1, which at its surface has an aperture through which the enlarged end portion 3 of the tension element 2 extends. The aperture in the tightening member 1 may have the shape of a keyhole so that the enlarged end portion 3 of the tension element 2 cannot move through the aperture 4 of the tightening member 1 when tension is exerted on the tension element 2.

Figure 2:
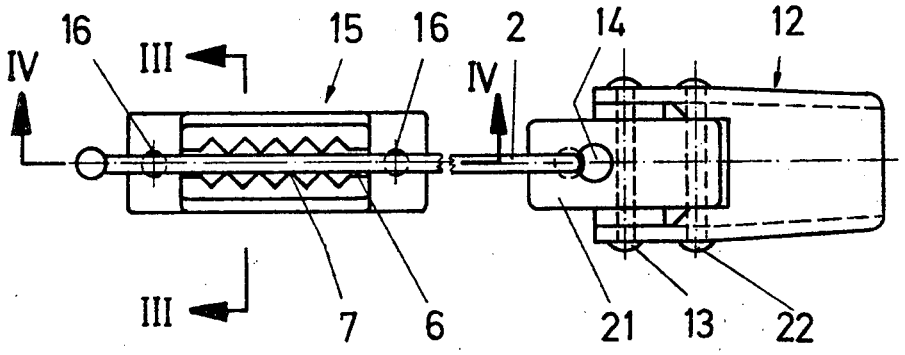
FIG. 2 is a top plan view showing an arrangement which is analogous to that of FIG. 1.
Figure 3:
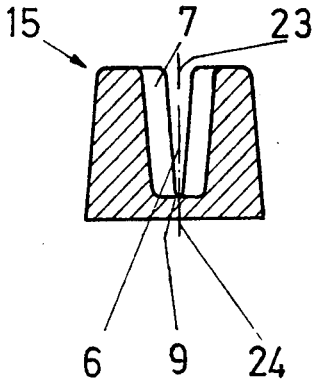
FIG. 3 is a sectional view taken on line III—III of FIG. 2.
Figure 4:
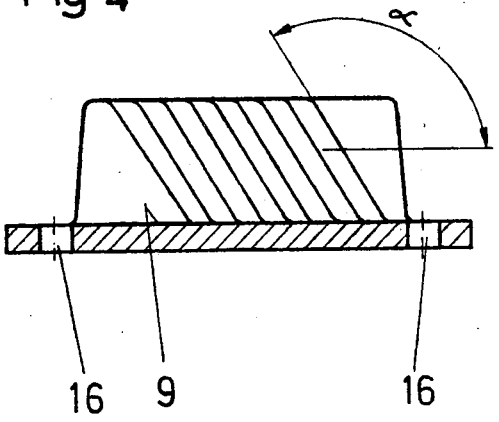
FIG. 4 is a sectional view taken on line IV—IV of FIG. 2.

In the embodiment shown in FIG. 1 the device for fixing the tension element consists of a member 5, which is formed with a groove 6, as is apparent from FIGS. 2,3 and 4. The tension element 2 has been inserted into the groove 6, which is defined by ribs 7 extending transversely to the longitudinal axis of the groove. The ribs 7 and the longitudinal axis of the inserted tension element include an angle $\alpha$ which exceeds 90° when measured from the pulling direction, which is indicated by an arrow 8. In response to tension exerted on the tension element 2 in the direction of the arrow 8, the tension element is pulled to the bottom 9 of the groove 6, which tapers toward its bottom 9 so that the tension element will be more strongly clamped in response to tension exerted thereon in the direction of the arrow 8. In the embodiment shown in FIG. 1 the tightening member 1 is secured to a shoe on one side 10 thereof and the device 5 for fixing the tension element is integral with that portion 11 of the shoe which is to be pulled toward the portion 10.

The embodiment shown in FIGS. 2,3 and 4 comprises a modified tightening member 12, which just as the tightening member 1 is pivoted on a pin 13. An extension 21 of this tightening member 12 has an aperture 14 in the shape of a keyhole. The enlarged end portion of the tension element 2 extends through the aperture 14 and is held in the narrower portion of the aperture 12 against leaving the same. That portion 21 of the tightening member 12 which is formed with the aperture 14 is hinged to the rest of the tightening member 12 on a pin 22, which is parallel to the pin 13. As a result, the portion 21 is closer to the surface of the shoe, when the tightening member 12 is closed. Above all, the hinged portion 21 increases the opening stroke so that a higher tension can be exerted. The device 15 for fixing the tension element differs from the device 5 for fixing the tension element only in that the baseplate of the device 15 has apertures 16 which permit the device 15 for fixing the tension element to be secured to the surface of the skiing boot by means of rivets or screws.

The cross-sectional shape of the groove 6 is clearly apparent from FIG. 3. At its open top 23, the width of the groove 6 when measured between the ribs 7 protruding toward the center line 24 of the groove distinctly exceeds the width of the groove 6 at its bottom 9.

FIG. 4 is an enlarged view showing the inclination of the ribs toward the plane of the bottom 9 of the groove. These ribs include with the pulling direction an angle $\alpha$ of about 120°. This inclination ensures a reliable anchoring of a tension element which has been inserted into the groove. The cross-sectional shape of the tension element is not clearly apparent from the figures of the drawing and may be circular, rectangular or trapezoidal. Alternatively, that portion of the tension element which is to be inserted into the device 5 or 15 may be provided with lateral teeth, which correspond to the spaces between the ribs 7. The tension element 2 may consist of plastic material. Alternatively, the portion to be received in the device for fixing the tension element may consist of a serrated strip of metal.

Figure 5:
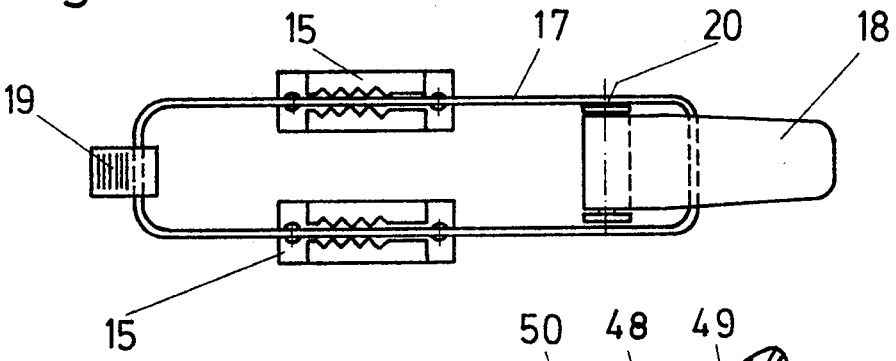
FIG. 5 shows another embodiment of the fastener according to the invention and FIG. 6 a modified device for fixing a tension element.

The device shown in FIG. 5 comprises two devices 15 for fixing a tension element 17. Both devices 15 may be secured to a common baseplate. The tension element 17 consists of a closed loop. One end of the tension element 17 is inserted in a tightening member 18. Each of the parts of the tension element 17 extending in the direction in which tension is exerted is clamped in one of the devices 15 for fixing the tension element 15. At its remote end from the tightening member 18, the tension element 17 has an extension 19, which facilitates the removal of the tension element 17 from the devices 15 for fixing it and the insertion of the tension element into said devices 15 when the tightening member 18 has been swung out of the plane of the drawing about the pin 20.

With reference to FIG. 6, a device 25 for fixing the tension element comprises a substantially cylindrical body, which is formed with a peripheral groove 26, which tapers toward its bottom 27. The resulting mushroom-shaped part may be secured to the surface of the shoe or of the tightening member.

At least part of the upper side face of the peripheral groove 26 is provided with ribs 28.

Each of the ribs 28 or a tangent 29 at the root of the rib includes an acute angle $\beta$ with a radial line 31 extending near the bottom 27 of the groove through the root 30 of the rib 28. In the embodiment shown by way of example the ribs 28 are not straight but curved but they may also be straight.

Figure 7:
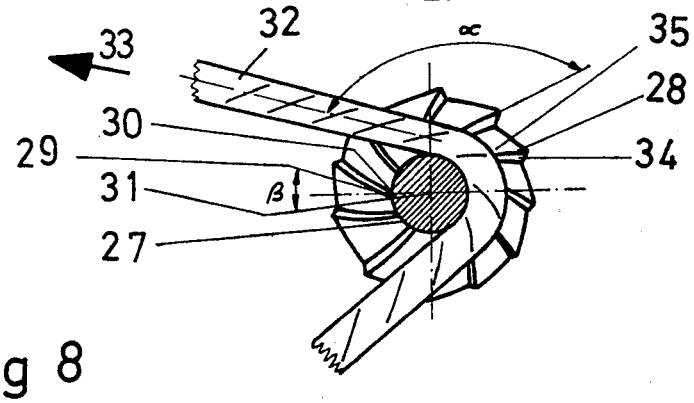
FIG. 7 is a sectional view taken on line VII—VII in FIG. 6.

In FIG. 7, an arrow 33 indicates the pulling direction of the tension element 32. The angle $\alpha$ included by the ribs 28 with that direction exceeds 90° so that the tension element 32 is forced under load against the bottom 27 of the groove. It is also apparent from FIGS. 6 and 7 that the side face 34 which faces opposite to the pulling direction 33 is steeper than the side face 35 which faces in the pulling direction.

FIG. 8 is a side elevation showing a skiing boot 36 and devices 37 for fixing a tension element 38. These devices 37 are similar to the device 25 in FIGS. 6 and 7 and are integral with the surface of the skiing boot.

With reference to FIG. 9, a tension element 39 is inserted in a claw 42 on one side 40 of two portions 40,41 of a shoe, which are to be pulled toward each other. The claw 42 has an extension 44, which is reversely bent to extend opposite to the pulling direction and prevents a pulling of the enlarged end 45 of the tension element 39 out of the claw 42 when the fastener is closed. The tension element may be fixed by any means desired, e.g., by means of rivets. In this embodiment, the device for fixing the tension element 39 and for adjusting the effective length thereof is integral with the tightening member, which consists of a lever 46. The lever 46 is pivoted at one end to the portion 41 of the shoe on a pin 47 and at its end remote from the pivotal axis has a groove 48 formed with grooves 49. FIG. 10 is a top plan view showing the tightening lever 46 and clearly indicating the ribs 49 which define the groove 48. Just as in all other embodiments of the invention, the ribs 49 and the pulling direction 43 include an angle which exceeds 90° so that the closing of the lever 46 will cause the tension element 39 to be pulled toward the bottom 50 of the groove.

The ribs 7, 28, 49 may consist of embossed portions of sheet metal sections or may be injection-molded.

In the embodiment shown in FIGS. 9 and 10 the bottom of the groove 48 terminates in front of that end of the tightening member which is remote from the pivot 47. For this reason the tension element 39 can pass through the groove 48 on that end of the tightening member 46 which is remote from the pivot 47 so that the tension element will be reliably held in the groove.

The tension element 51 shown in FIG. 11 has stiffening ribs 52, which extend transversely to the longitudinal axis of the tension element 51. The bottom 54 of the groove again terminates in front of that end of the tightening member 53 which is remote from the pivot 55 so that the tension element 51 can pass through downwardly. As is apparent in FIG. 12 the tightening member 53 has lateral teeth 56, which mesh with lateral teeth 57 of the tension element 52. The latter is secured to the outside of the shoe by simple means, such as a screw 58.

In the embodiment shown in FIGS. 13 and 14 the tightening member 59 is tubular and the tension element 60 extends through the cavity of the tubular tightening member 59. At one end, the tension element 60 has an enlarged portion 61, which prevents a pulling of the tension element 60 out of the cavity of the tubular tightening member 59. At its end remote from the tightening member 59, the tension element 60 is also formed with lateral teeth 65, which can be interengaged with mating teeth on the outside of the shoe. Such design is shown by way of example in FIG. 15, where the lateral teeth 65 of the tension element 60 can be interengaged with a trough-shaped clamping member 63, which has internal lateral teeth 62. Just as the tension element 60, that clamping member is substantially trapezoidal in cross-section. To reinforce the tension element 60 and to reduce the danger of a deflection thereof, the tension element has ribs 64, which are transverse to its longitudinal axis. The width a of the tension element 60 exceeds the inside width b of the section member 63 at the bottom of the groove. As a result, the clamping will be ensured for a substantial time even when the edges of the teeth of the tension element have suffered considerable wear.

As is apparent from FIG. 11, the tightening member is preferably designed to be locked in its open position by a stop 67, which may be integrally formed in the baseplate as it is stamped and which cooperates with the underside 66 of the tightening member 53 in its open position so that the maximum angle to which the tightening member 53 can be opened is limited by the stop 67 and the cooperating stop 66.

What we claim is:

1. A shoe fastener, particularly for skiing boots, comprising a tightening member, which acts on a tension element, and means for fixing the tension element and for selecting the effective length thereof, characterized in that the tension element consists of a flexible strap which is substantially trapezoidal in cross-section and has teeth on its longitudinal sides and further in that the device for fixing the tension element comprises a groove, which tapers toward its bottom with the width of the tension element exceeding the width of the groove at its bottom, and the groove extends in the longitudinal direction of the tension element and is defined by side faces, at least one of which is formed with ribs, each of which at least at its end near the bottom of the groove extends transversely to the longitudinal axis of the groove and each rib and the pulling direction of the tension element inserted in the groove include an angle which is open toward the open side of the groove and exceeds 90°, the ribs further having side faces which are steeper on the side that faces opposite to the pulling direction than on the side which faces in the pulling direction.

2. A device according to claim 1, characterized in that the groove (48) constitutes a part of the tightening member (46) and is preferably integral therewith.

3. A device according to claim 1, characterized in that the groove (6,26) is fixed to the shoe on the side thereof which is opposite to the tightening member (12,18).

4. A device according to claim 1, characterized in that the groove (6) is integral with the surface of the shoe (1).

5. A device according to claim 1, characterized in that the tension element is formed between its longitudinal edges with ribs which extend transversely to its longitudinal direction.

6. A device according to claim 1, characterized in that the tightening member is tubular and the tension element extends through the cavity of the tightening member.

7. A device according to claim 1, characterized in that the bottom of the groove in the tightening member terminates in the tightening member in front of the free end thereof which is remote from the pivotal axis of the tightening member.

* * * * *